US010962921B2

(12) United States Patent
Ishii et al.

(10) Patent No.: US 10,962,921 B2
(45) Date of Patent: Mar. 30, 2021

(54) CONNECTING STRUCTURE BETWEEN ELECTRICAL CONNECTOR OF SHEET FEEDER AND ELECTRICAL CONNECTOR OF IMAGE FORMING APPARATUS TO BE INSTALLED ONTO TOP OF THE SHEET FEEDER

(71) Applicant: KYOCERA Document Solutions Inc., Osaka (JP)

(72) Inventors: Akira Ishii, Osaka (JP); Masayuki Yamada, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/004,257

(22) Filed: Aug. 27, 2020

(65) Prior Publication Data

US 2021/0063950 A1 Mar. 4, 2021

(30) Foreign Application Priority Data

Aug. 28, 2019 (JP) ..... JP2019-155839

(51) Int. Cl.
*G03G 21/16* (2006.01)
*G03G 15/00* (2006.01)

(52) U.S. Cl.
CPC ..... *G03G 21/1647* (2013.01); *G03G 15/6502* (2013.01); *G03G 21/1619* (2013.01); *G03G 2221/1654* (2013.01)

(58) Field of Classification Search
CPC ..... G03G 15/6502; G03G 21/1619; G03G 21/1647; G03G 2221/1654
See application file for complete search history.

(56) References Cited

U.S. PATENT DOCUMENTS 5,666,595 A * 9/1997 Sameshima ..... G03G 15/6502 24/658
5,940,116 A * 8/1999 Park ..... G03G 21/1652 347/152
6,836,628 B2 * 12/2004 Funakoshi ..... G03G 15/80 399/107

(Continued)

FOREIGN PATENT DOCUMENTS

JP 2012-118178 6/2012

*Primary Examiner* — Sophia S Chen
(74) *Attorney, Agent, or Firm* — Wenderoth, Lind & Ponack, L.L.P.

(57) ABSTRACT

An electrical connector of an image forming apparatus exposes outward from a bottom surface of the image forming apparatus. An electrical connector of a sheet feeder protrudes from a top surface of the sheet feeder. The sheet feeder has a slider configured to be horizontally movable, while holding the electrical connector of the sheet feeder, between a connecting position at which the electrical connectors of the sheet feeder and image forming apparatus are connected and a disconnecting position at which the electrical connectors are disconnected. A locking member having a locking engaged part is fixed to the image forming apparatus. When the slider is moved to the connecting position, a locking engaging part of the slider engages the locking engaged part of the locking member so that the locking member and the slider are locked such that they cannot be separated vertically from each other.

5 Claims, 17 Drawing Sheets

(56) References Cited

U.S. PATENT DOCUMENTS

2005/0100362 A1* 5/2005 Kim ..... G03G 15/50
399/107
2006/0248733 A1* 11/2006 Masai ..... G03G 21/1652
30/377

* cited by examiner

CONNECTING STRUCTURE BETWEEN ELECTRICAL CONNECTOR OF SHEET FEEDER AND ELECTRICAL CONNECTOR OF IMAGE FORMING APPARATUS TO BE INSTALLED ONTO TOP OF THE SHEET FEEDER

CROSS-REFERENCE TO RELATED APPLICATION(S)

This application is based upon and claims the benefit of priority from Japanese Patent Application No. 2019-155839 filed on Aug. 28, 2019, the entire contents of which are incorporated herein by reference.

BACKGROUND

The technology disclosed herein relates to a connecting structure between an electrical connector of a sheet feeder and an electrical connector of an image forming apparatus to be installed onto the top of the sheet feeder.

There are cases where an optional sheet feeder is attached to a side face or the bottom face of an image forming apparatus such as a printer or a multifunction peripheral. In the case where an optional sheet feeder is attached to the bottom face of an image forming apparatus, the image forming apparatus is placed and installed onto the top of the optional sheet feeder that is set on a floor. In this process, a positioning hole formed in a bottom surface of the image forming apparatus is engaged with a positioning pin protruding from a top surface of the optional sheet feeder to position the optional sheet feeder relative to the image forming apparatus, and simultaneously an electrical connector arranged to expose from the bottom surface of the image forming apparatus and an electrical connector arranged to protrude from the top surface of the sheet feeder are mated together.

However, in this configuration in which the electrical connector of the sheet feeder protrudes from the top surface of the sheet feeder, the electrical connector can be broken due to interference with the image forming apparatus when the image forming apparatus is installed onto the top of the sheet feeder.

To solve this problem, a connecting structure has been proposed which is configured such that the electrical connector of the sheet feeder is retracted to a position lower than the top surface of the sheet feeder, and, after the image forming apparatus is installed onto the sheet feeder, a manual lever is operated to raise the electrical connector of the sheet feeder to mate the electrical connector of the sheet feeder with the electrical connector of the image forming apparatus.

SUMMARY

An aspect of the present disclosure provides a connecting structure between an electrical connector of a sheet feeder and an electrical connector of an image forming apparatus to be installed onto a top of the sheet feeder.

The electrical connector of the image forming apparatus is arranged to expose outward from a bottom surface of the image forming apparatus. The electrical connector of the sheet feeder is arranged to protrude outward from a top surface of the sheet feeder. The sheet feeder has a slider. The slider is configured to be horizontally movable, while holding the electrical connector of the sheet feeder, between a connecting position at which the electrical connector of the sheet feeder is connected to the electrical connector of the image forming apparatus and a disconnecting position which is spaced from the connecting position and at which the electrical connector of the sheet feeder and the electrical connector of the image forming apparatus are disconnected. The image forming apparatus has a locking member fixed thereto that has a locking engaged part. The slider has a locking engaging part provided thereon that is configured to be engageable with the locking engaged part. When the slider is at the connecting position, the locking engaging part of the slider engages with the locking engaged part of the locking member to lock the locking member and the slider such that the locking member and the slider cannot be separated vertically from each other. When the slider is at the disconnecting position, the locking engaging part of the slider and the locking engaged part of the locking member are disengaged to unlock the slider and the locking member.

DETAILED DESCRIPTION

Hereinafter, an example embodiment of the present disclosure will be described in detail on the basis of the drawings. It should be understood that the technology disclosed herein is not limited to the embodiment described below.

Embodiment

Figure 1:
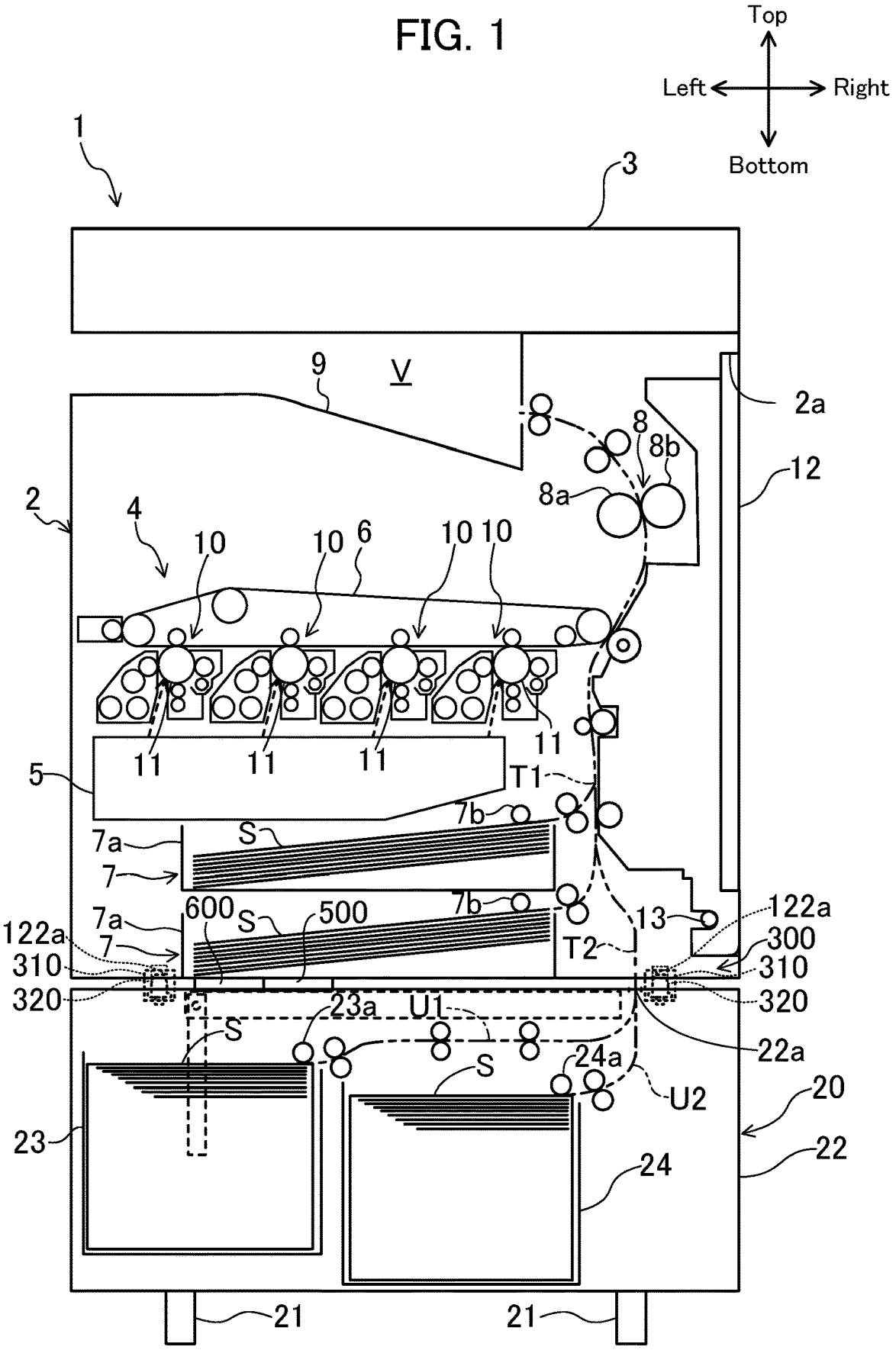
FIG. 1 is a schematic diagram illustrating inner structures of an image forming apparatus and an optional sheet feeder that are electrically connected to each other by a connecting structure according to an embodiment of the present disclosure.

FIG. 1 is a schematic diagram illustrating a configuration of an optional sheet feeder 20 and an image forming apparatus 1 installed on the top of the optional sheet feeder 20. An electrical connector 500 of the optional sheet feeder 20 and an electrical connector 600 of the image forming apparatus 1 are connected to each other by a connecting structure according to an embodiment of the present disclosure. Note that the terms "front", "rear", "left", and "right" in the following description are defined with respect to the image forming apparatus 1 and conform to the directional axis definition shown in the figures.

The optional sheet feeder 20 has four casters 21 on a bottom surface thereof and is installed on a floor. The image forming apparatus 1 is installed on the top of the optional sheet feeder 20. The image forming apparatus 1 is positioned in the front-rear direction and the left-right direction relative to the optional sheet feeder 20 by a positioning structure 300 that is described later.

The optional sheet feeder 20 has the electrical connector 500 on a rear side thereof and the electrical connector 500 protrudes from the top surface of the optional sheet feeder 20. The image forming apparatus 1 has the electrical connector 600 on a rear side thereof and the electrical connector 600 exposes from the bottom surface of the image forming apparatus 1. The electrical connectors 500 and 600 are connected to each other so as to feed power from the image forming apparatus 1 to the optional sheet feeder 20.

[Configuration of Image Forming Apparatus 1] The image forming apparatus 1 is composed of, for example, an in-body sheet discharge type copying machine and incudes an image forming apparatus body 2 and an image reader 3 provided on the top of the image forming apparatus body 2. The image reader 3 optically reads an image of a document and generates image data of the document.

The image forming apparatus body 2 has therein an image forming part 4 that forms an image on a sheet S by transfer on the basis of the image data generated by the image reader 3. An exposure device 5 that radiates a laser beam is arranged below the image forming part 4. A transfer belt 6 is arranged above the image forming part 4. Two sheet feeders 7 are arranged one on another below the exposure device 5. The optional sheet feeder 20, which is described later, is arranged below the lower sheet feeder 7. A fixing unit 8 that performs a fixing process on the image formed on the sheet S is arranged at a higher position than the transfer belt 6 at the right side of the transfer belt 6. A sheet discharge space V into which the sheet S subjected to the fixing process by the fixing unit 8 is discharged is provided between the image forming apparatus body 2 and the image reader 3. A sheet discharge tray 9 that receives the sheet S discharged into the sheet discharge space V is formed on a top surface of the image forming apparatus body 2.

The image forming apparatus body 2 has therein a sheet conveying path T1 and an optional conveying path T2. The sheet conveying path T1 extends from the sheet feeders 7 toward the sheet discharge tray 9, and the optional conveying path T2 extends from the optional sheet feeder 20 and joins the sheet conveying path T1. Each sheet feeder 7 has a sheet feed cassette 7*a* that is configured to be able to be pulled out to the front side. Each sheet feed cassette 7*a* contains sheets S (composed of, for example, paper sheets, OHP sheets, or any other type of sheets) stacked in a bundle. Each sheet feeder 7 picks up an uppermost one of the sheets S one by one with a pick-up roller 7*b* and sequentially feeds the picked-up sheets S to the sheet conveying path T1.

The image forming part 4 includes four image forming units 10 that respectively correspond to four colors of yellow, magenta, cyan, and black. Each image forming unit 10 includes a photosensitive drum 11. In each image forming unit 10, an electrostatic latent image that is formed on the photosensitive drum 11 by the exposure device 5 is developed by a developing device so that the electrostatic latent image is visualized as a toner image of the corresponding color. The image forming part 4 sequentially transfers the toner images from the photosensitive drums 11 of the image forming units 10 onto the transfer belt 6 such that the toner images are superimposed one on another, and then transfers the superimposed toner images onto a sheet S fed from the sheet feeders 7 or the optional sheet feeder 20.

The fixing unit 8 includes a heat roller 8*a* and a pressure roller 8*b*. The fixing unit 8 heats and presses the toner images carried on the sheet S fed from the image forming part 4 while the sheet S passes between the rollers 8*a* and 8*b*, whereby the toner images are heat-fixed on the sheet S. The sheet S subjected to this heat-fixing process is discharged onto the sheet discharge tray 9.

The image forming apparatus body 2 has a rectangular opening 2*a* formed in a right side surface thereof that adjoins the sheet conveying path T1 and the optional conveying path T2. The opening 2*a* is able to be opened and closed by an openable cover 12. The openable cover 12 is turnably supported on a shaft 13 extending along a lower edge of the opening 2*a*. The openable cover 12 in the closed state is brought into the opened state by turning to the outer side of the image forming apparatus body 2 (the right side in FIG. 1) about the shaft 13. Bringing the openable cover 12 into the opened state allows a user to deal with a sheet jammed in the sheet conveying path T1 or the optional conveying path T2.

[Configuration of Optional Sheet Feeder 20]

The optional sheet feeder 20 is externally attached to a bottom surface of the image forming apparatus 1. The optional sheet feeder 20 has a casing 22 that has the four casters 21 on a bottom surface thereof. The casing 22 is formed by covering the faces of a skeleton frame 200 assembled in a substantially rectangular parallelepiped shape (see FIG. 4) with an outer cover made of resign. The casing 22 houses a pair of sheet feed cassettes 23, 24 that are arranged side by side in the left-right direction such that they are able to be pulled out to the front side. Each sheet feed cassette 23, 24 contains sheets S stacked in a bundle. The capacity of each sheet feed cassette 23, 24 is set to be greater than that of each sheet feed cassette 7 included as standard in the image forming apparatus 1, so that the sheet feed cassettes 23, 24 are available also for a business purpose that requires mass printing.

The casing 22 has a sheet outlet 22*a* formed in a right end portion of a top surface thereof. The casing 22 has therein a first sheet conveying path U1 and a second sheet conveying path U2 that respectively extend from the sheet feed cassettes 23 and 24 to the sheet outlet 22*a*. The sheet conveying paths U1 and U2 join together at the sheet outlet 22*a* and connect to the optional conveying path T2 in the image forming apparatus 1. The optional sheet feeder 20 picks up an uppermost one of the sheets S contained in each sheet feed cassette 23, 24 one by one with each pick-up roller 23*a*, 24*a* and sequentially feeds the picked-up sheets S to each sheet conveying path U1, U2. The sheets S fed to each sheet conveying path U1, U2 are fed to the optional conveying path T2 in the image forming apparatus body 2 through the sheet outlet 22*a*.

Figure 2:
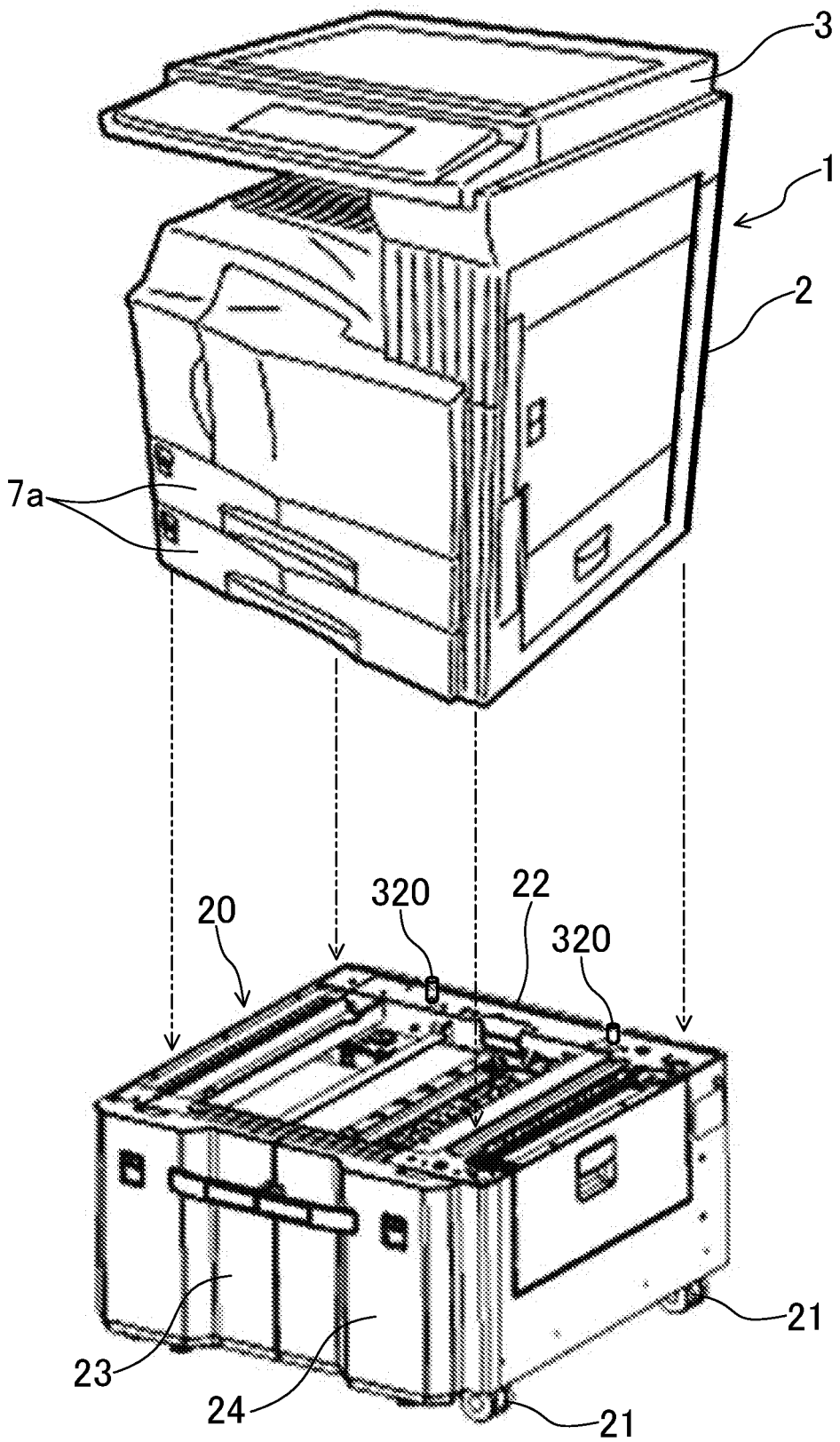
FIG. 2 is a perspective view illustrating the image forming apparatus and the optional sheet feeder separately.

As shown in FIG. 2, the optional sheet feeder 20 is configured to be able to be separated from the image forming apparatus 1. The image forming apparatus 1 is, as described above, installed on a top surface of the optional sheet feeder 20. If there is a deviation in the position of installation of the image forming apparatus 1, failures can occur, such as occurrence of a jam during the sheet feeding operation performed by the optional sheet feeder 20, or inability to feed power caused by unsuccessful mating of the electrical connector 500 of the optional sheet feeder 20 with the electrical connector 600 of the image forming apparatus 1.

In order to prevent such failures, the image forming apparatus 1 and the optional sheet feeder 20 are positioned relative to each other by a positioning structure 300 (see FIG. 1).

In the positioning structure 300, a pair of left and right pin members 320 are provided to protrude from the top surface of the optional sheet feeder 20. The pin members 320 are respectively engaged with positioning holes 122*a* formed in the bottom surface of the image forming apparatus 1 so that positional relation in the front-rear direction and the left-right direction between a skeleton frame 100 of the image forming apparatus 1 and the skeleton frame 200 of the optional sheet feeder 20 is regulated.

Figure 3:
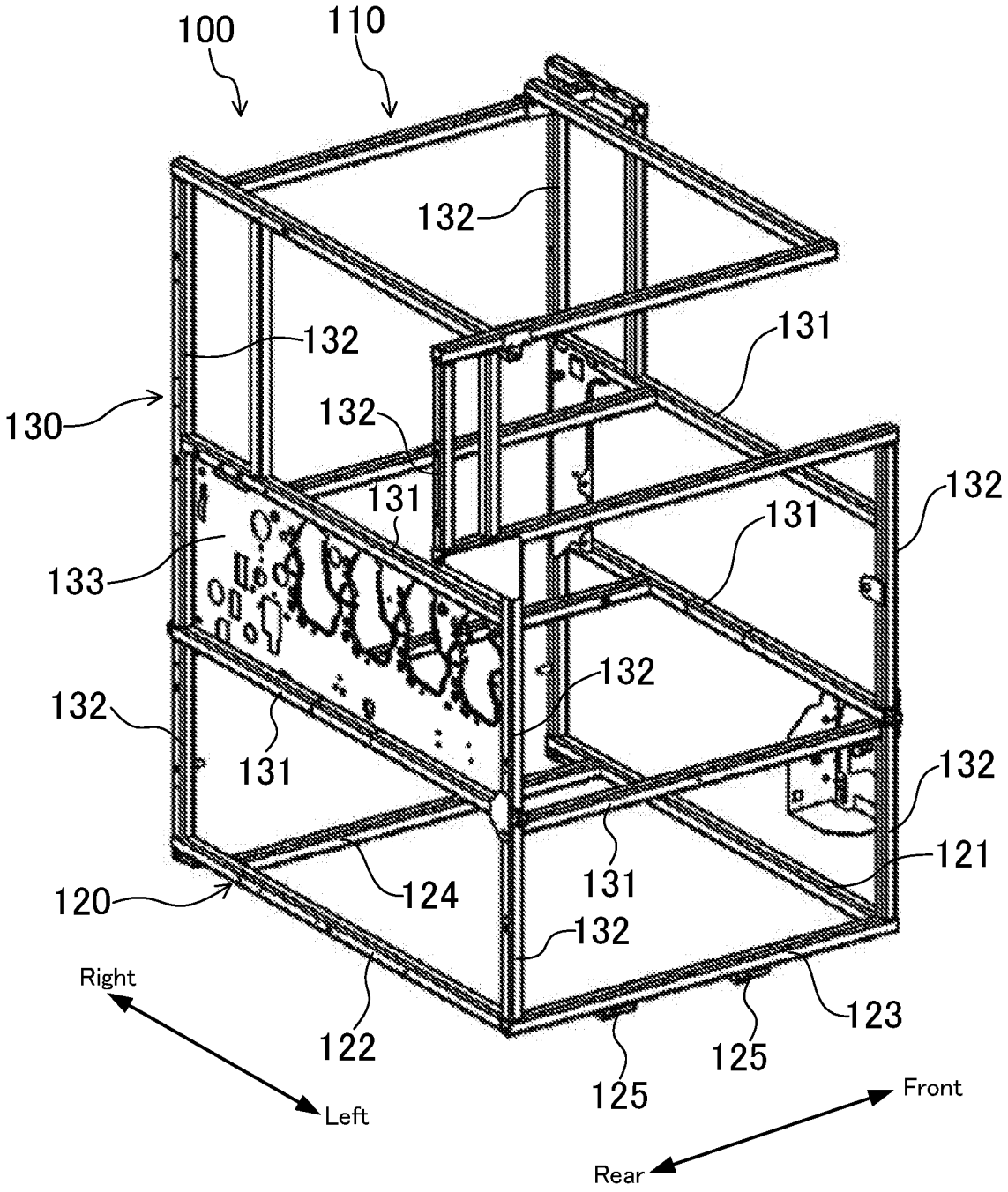
FIG. 3 is a perspective view illustrating a skeleton frame of the image forming apparatus.

As shown in FIG. 3, the skeleton frame 100 of the image forming apparatus 1 is formed by fitting together pipes (example of horizontal beam) having a rectangular cross section. Specifically, the skeleton frame 100 has an upper end frame part 110, a lower end frame part 120, and an intermediate frame part 130. The upper end frame part 110 and the lower end frame part 120 are each formed in a rectangular shape extending in the left-right direction. The upper face of the upper end frame part 110 constitutes a face on which the image reader 3 is mounted. The lower face of the lower end frame part 120 constitutes a face to be joined to the skeleton frame 200 of the optional sheet feeder 20. The intermediate frame part 130 is formed in a three-dimensional shape by fitting together horizontal pipes 131 and vertical pipes 132. The upper end frame part 110 and the lower end frame part 120 are connected to each other with the intermediate frame part 130 interposed therebetween. The intermediate frame part 130 has a sheet metal frame 133 attached to the rear face thereof, which is in contact with rear end surfaces of the image forming units 10.

The lower end frame part 120 includes a front horizontal pipe 121 and a rear horizontal pipe 122 that are spaced from each other in the front-rear direction, and a left horizontal pipe 123 and a right horizontal pipe 124 that are spaced from each other in the left-right direction. The rear horizontal pipe 122 has a pair of positioning holes 122*a* (see FIGS. 1 and 7) formed in a lower surface thereof, which are spaced from each other in the left-right direction. The positioning holes 122*a* are to be engaged with pin members 320 provided on the optional sheet feeder 20. Each pin member 320 is attached to the skeleton frame 200 of the optional sheet feeder 20 (see FIG. 4) along with a positioning aiding member 310. The left horizontal pipe 123 and the right horizontal pipe 124 each have a pair of vibration damping pads 125 attached to a lower surface thereof, which are spaced from each other in the front-rear direction. The vibration damping pads 125 have a thickness slightly greater than a gap formed between the lower end frame part 120 of the image forming apparatus 1 and an upper end frame part 210 of the optional sheet feeder 20.

Figure 4:
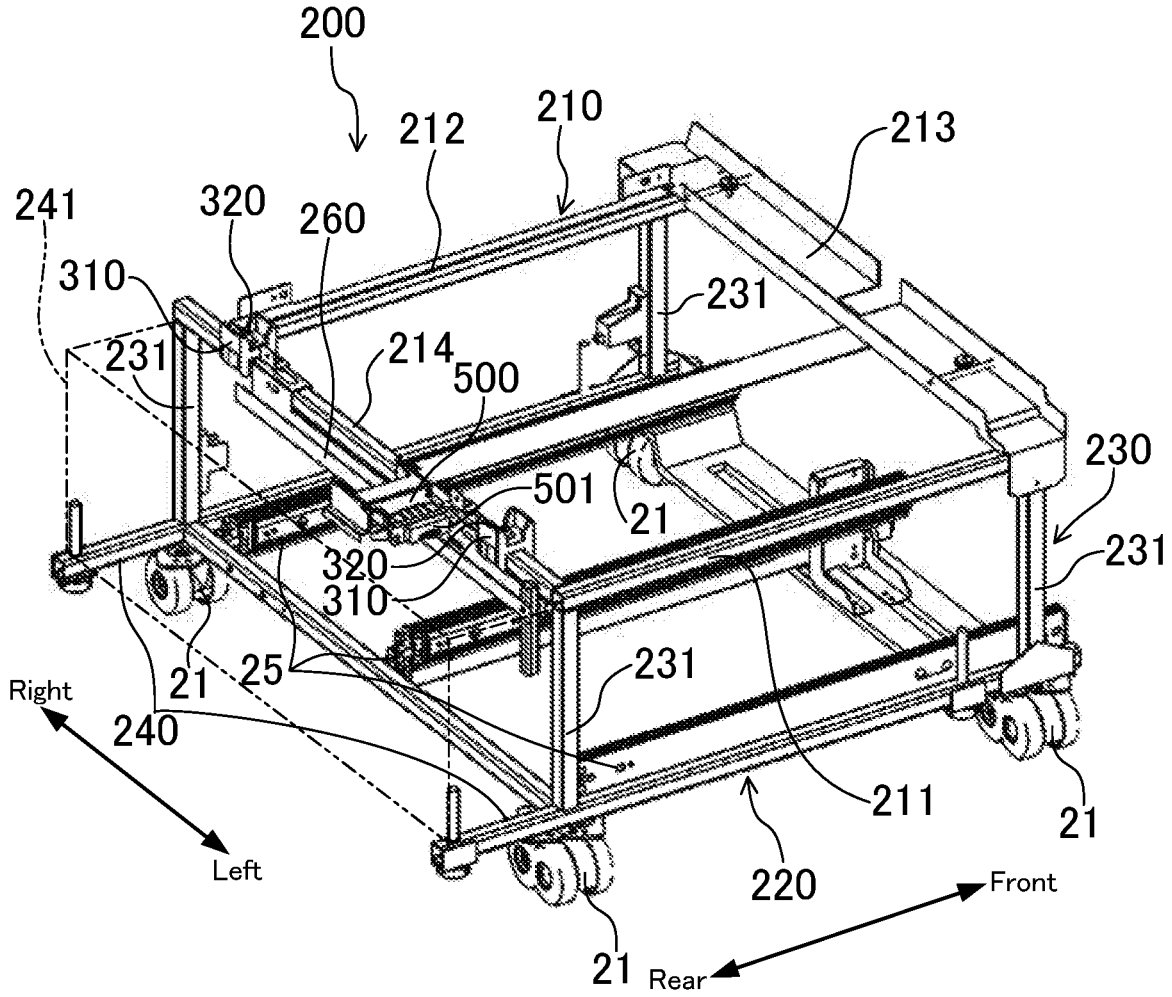
FIG. 4 is a perspective view illustrating a skeleton frame of the optional sheet feeder.

As shown in FIG. 4, the skeleton frame 200 of the optional sheet feeder 20 has an upper end frame part 210, a lower end frame part 220, and an intermediate frame part 230. The upper end frame part 210 and the lower end frame part 220 are each formed in a rectangular shape extending in the left-right direction. The upper face of the upper end frame part 210 constitutes a face to be joined to the skeleton frame 100 of the image forming apparatus 1. The lower end frame part 220 has the aforementioned four casters 21 on a lower surface thereof. The lower end frame part 220 has three rail members 25 attached thereto that guide the left and right sheet feed cassettes 23 and 24 of the optional sheet feeder 20 in the front-rear direction. The lower end frame part 220 has a pair of support pipes 240 connected to a rear end thereof, which extend in the front-rear direction and support a control box 241 (example of box member). The control box 241 houses a control board and other components for controlling operation of the optional sheet feeder 20.

The intermediate frame part 230 consists of four vertically extending vertical pipes 231 and connects the four corners of the upper end frame part 210 to the four corners of the lower end frame part 220.

The upper end frame part 210 includes a left horizontal pipe 211 and a right horizontal pipe 212 that are spaced from each other in the left-right direction, a reinforcing sheet metal 213 that connects front ends of the left and right horizontal pipes 211 and 212, and a rear horizontal pipe 214 that connects rear ends of the left and right horizontal pipes 211 and 212.

The rear horizontal pipe 214 has a pair of pin members 320, each along with a positioning aiding member 310, attached thereto. The rear horizontal pipe 214 has a slider 260 attached thereto that supports the electrical connector 500.

[Configurations of Positioning Aiding Member 310 and Pin Member 320]

Figure 5:
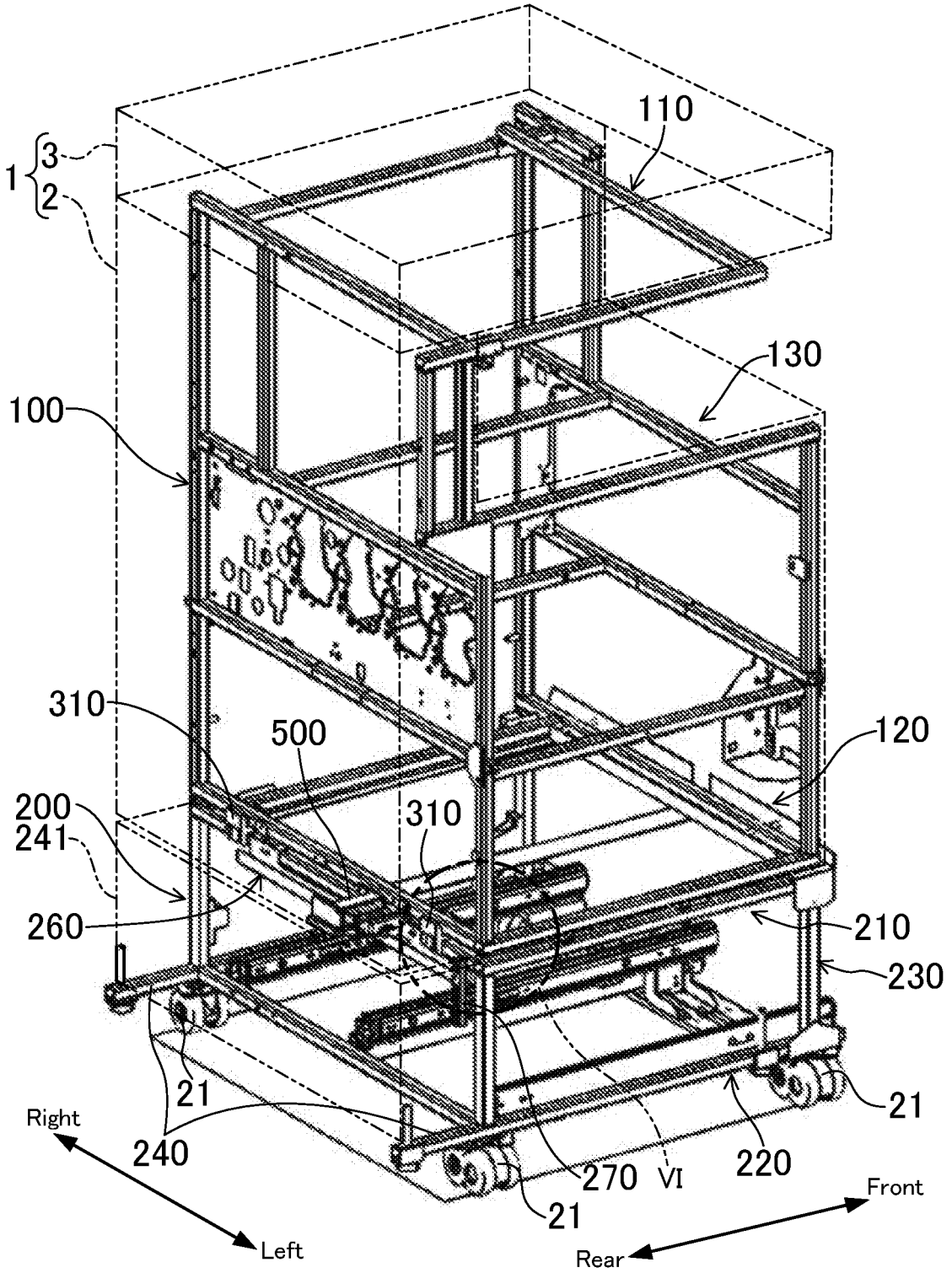
FIG. 5 is a perspective view showing a state where the skeleton frame of the image forming apparatus is installed on the top of the skeleton frame of the optional sheet feeder.
Figure 6:
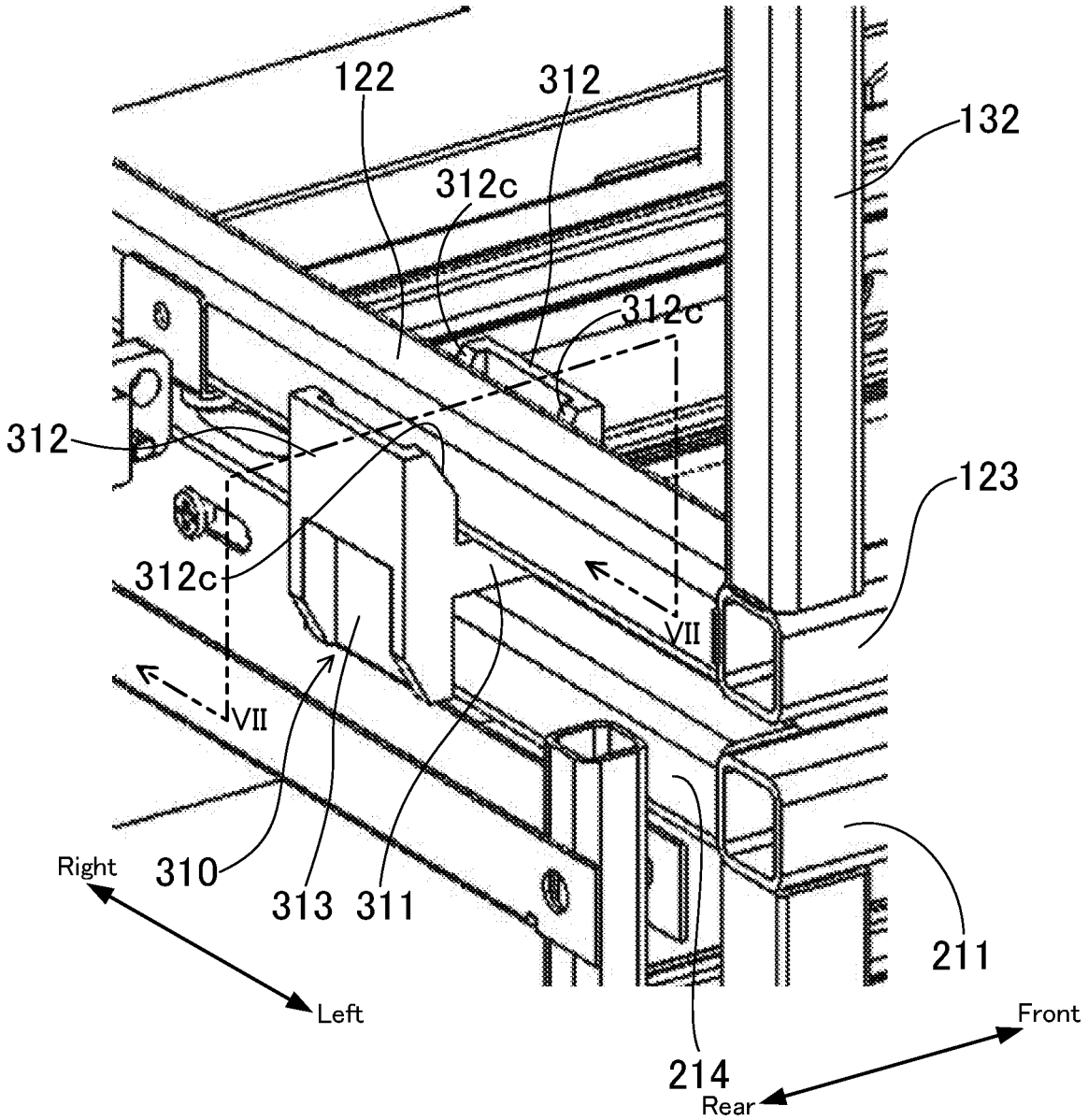
FIG. 6 is an enlarged perspective view of circled region VI in FIG. 5.
Figure 7:
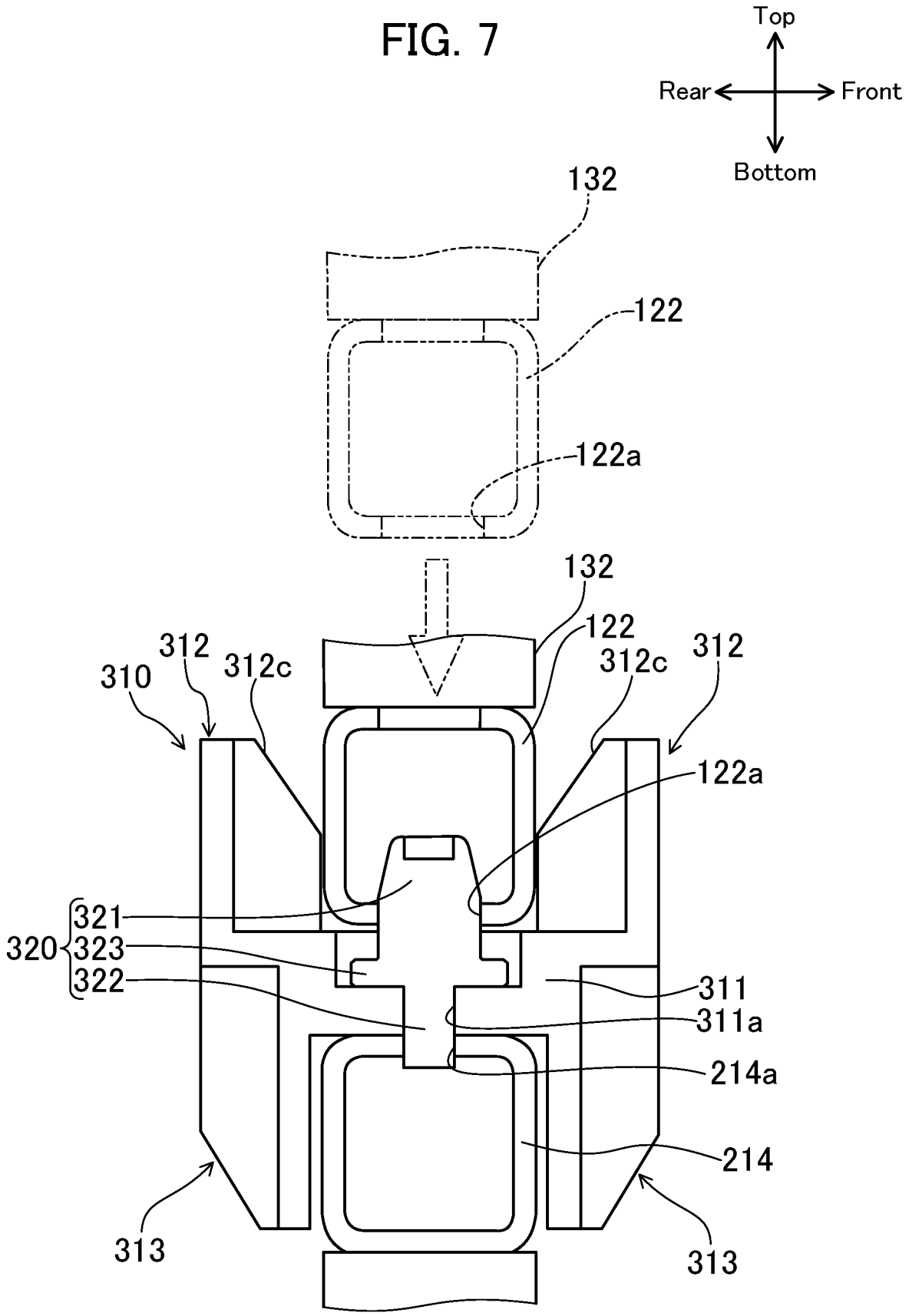
FIG. 7 is a sectional view taken along line VII-VII in FIG. 6.

FIG. 5 shows a state where the above-described skeleton frame 100 of the image forming apparatus 1 (see FIG. 3) is installed on the top of the skeleton frame 200 of the optional sheet feeder 20 (see FIG. 4). FIG. 6 is an enlarged view of circled region VI in FIG. 5. FIG. 7 is a sectional view taken along line VII-VII in FIG. 6.

As shown in these figures, the positioning aiding member 310 is interposed between the skeleton frame 200 of the optional sheet feeder 20 and the skeleton frame 100 of the image forming apparatus 1 and engaged with both of them. Specifically, the positioning aiding member 310 is formed to have an H-shaped cross section as viewed in the left-right direction.

More specifically, the positioning aiding member 310 has a resting board part 311 that rests on an upper surface of the rear horizontal pipe 214 of the optional sheet feeder 20, a pair of upward extending parts 312 that protrude from an upper surface of the resting board part 311, and a pair of downward extending parts 313 that protrude from a lower surface of the resting board part 311.

The pin member 320 has a first positioning pin part 321, a second positioning pin part 322 that has a smaller diameter than the first positioning pin part 321, and a seating part 323 that is formed at the boundary between the first and second positioning pin parts 321 and 322. The second positioning pin part 322 of the pin member 320 is fitted into both a positioning hole 311*a* of the positioning aiding member 310 and a positioning hole 214*a* of the rear horizontal pipe 214 of the optional sheet feeder 20 so that the pin member 320 is positioned relative to and fixed to the rear horizontal pipe 214. Further, the first positioning pin part 321 of the pin member 320 is fitted into the positioning hole 122*a* formed in the rear horizontal pipe 122 of the image forming apparatus 1 so that the image forming apparatus 1 is positioned relative to the optional sheet feeder 20. The positioning aiding member 310 is configured such that, when an operator installs the image forming apparatus 1 onto the top of the optional sheet feeder 20, guide surfaces 312*c* formed on the pair of upward extending parts 312 guide the rear horizontal pipe 122 of the image forming apparatus 1 such that the rear horizontal pipe 122 approaches the pin member 320. Thus, the positioning aiding member 310 has the function of aiding the positioning of the image forming apparatus 1 relative to the optional sheet feeder 20.

[Summary of Connecting Structure Between Electrical Connectors 500 and 600]

Figure 8:
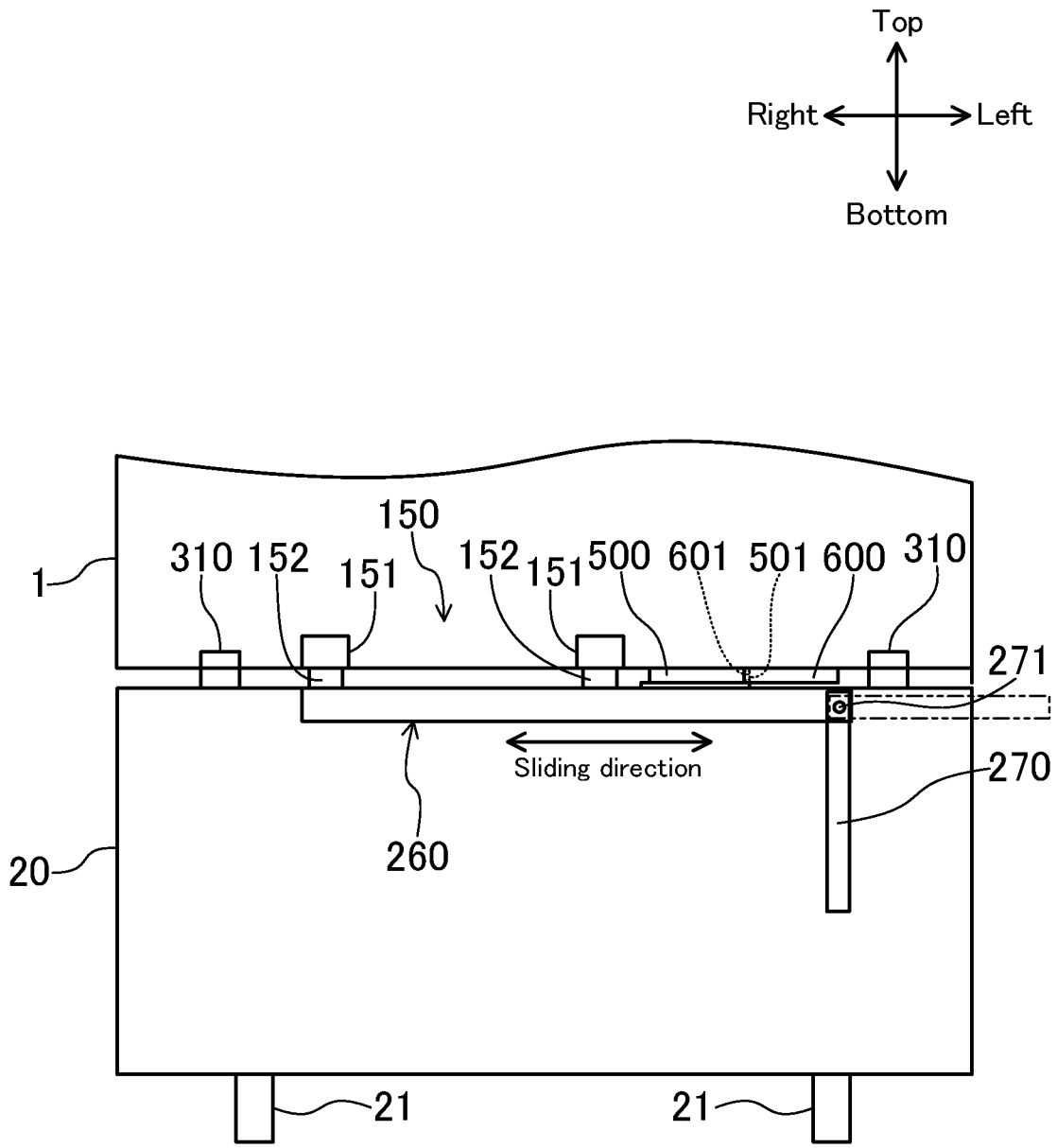
FIG. 8 is a schematic diagram illustrating the boundary between the image forming apparatus and the optional sheet feeder as viewed from the rear side.

Next, a connecting structure between the electrical connector 500 of the optional sheet feeder 20 and the electrical connector 600 of the image forming apparatus 1 is described with reference to FIG. 8.

The electrical connector 600 of the image forming apparatus 1 has a flat rectangular shape having a thickness in the vertical direction. The electrical connector 600 exposes through an opening (illustration omitted) formed in the bottom surface of the image forming apparatus 1. The electrical connector 600 is fixed on an upper surface of a horizontal support board (illustration omitted) that is fixed to the skeleton frame 100 of the image forming apparatus 1. An insertion port 601 of the electrical connector 600 is oriented to the right side (the left side of FIG. 8) so as to face an insertion port 501 of the electrical connector 500 of the optional sheet feeder 20.

Similarly to the electrical connector 600 of the image forming apparatus 1, the electrical connector 500 of the optional sheet feeder 20 has a flat rectangular shape having a thickness in the vertical direction. The electrical connector 500 protrudes vertically through an opening (illustration omitted) formed in the top surface of the optional sheet feeder 20. The electrical connector 500 is supported by the slider 260 with the insertion port 501 of the electrical connector 500 oriented to the left side (the right side of FIG. 8).

The slider 260 is supported by the skeleton frame 200 of the optional sheet feeder 20 (see FIG. 4) to be slidable in the left-right direction. More specifically, the slider 260 is configured to be slidable between a connecting position at which the electrical connector 500 of the optional sheet feeder 20 is connected to the electrical connector 600 of the image forming apparatus 1 (the position shown in FIG. 8) and a disconnecting position which is spaced to the right side (the left side of FIG. 8) from the connecting position and at which the electrical connectors 500 and 600 are disconnected.

The slider 260 is coupled with a foldable handle lever 270 (example of handle) that is described later. An operator (including a user) can slide the slider 260 in the left-right direction by deploying the handle lever 270 into the horizontally extending state and pulling or pushing the handle lever 270 leftward or rightward.

The image forming apparatus 1 has a locking mechanism 150 provided thereon that locks the slider 260 when the slider 260 reaches the connecting position from the disconnecting position. By the slider 260 that is provided on the optional sheet feeder 20 being locked by the locking mechanism 150, the image forming apparatus 1 and the optional sheet feeder 20 are coupled to each other such that they cannot be separated vertically from each other. Details of the locking mechanism 150 are described later.

[Details of Slider 260]

Figure 9:
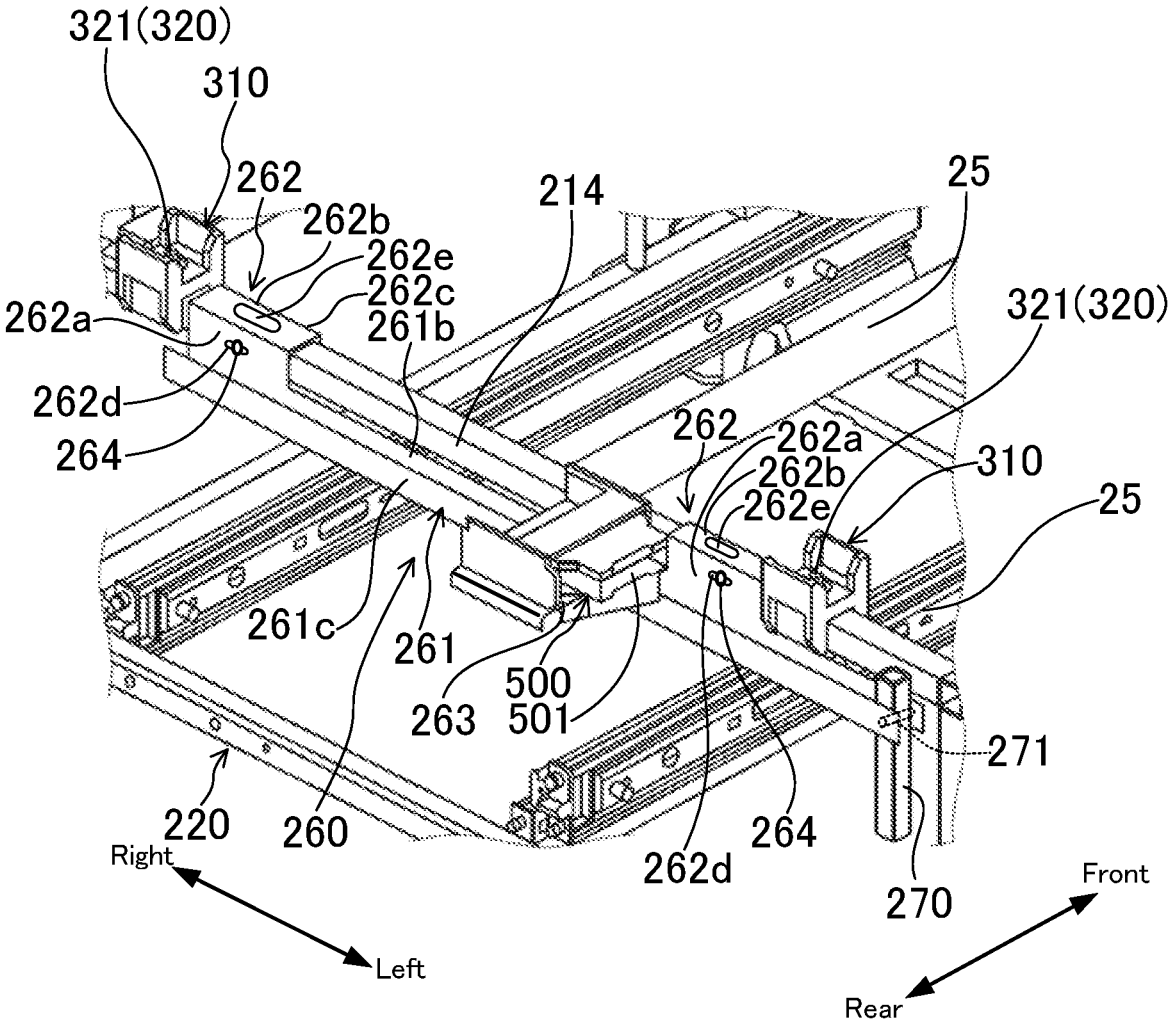
FIG. 9 is a perspective assembled view of the skeleton frame of the optional sheet feeder and a slider supporting an electrical connector and mounted on the skeleton frame of the sheet feeder.

A configuration of the slider 260 is described in detail with reference to FIGS. 9 to 11. As shown in FIG. 9, the slider 260 is mounted on the rear horizontal pipe 241 that constitutes a part of the upper end frame part 210 of the optional sheet feeder 20. The slider 260 is provided to extend in the light-left direction along the rear horizontal pipe 214. The handle lever 270 is foldably coupled to a left end of the slider 260.

Figure 10:
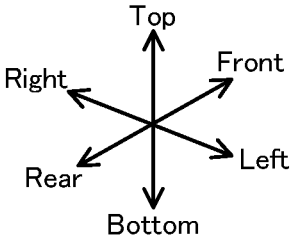
FIG. 10 is a perspective view illustrating the slider supporting the electrical connector.
Figure 10:
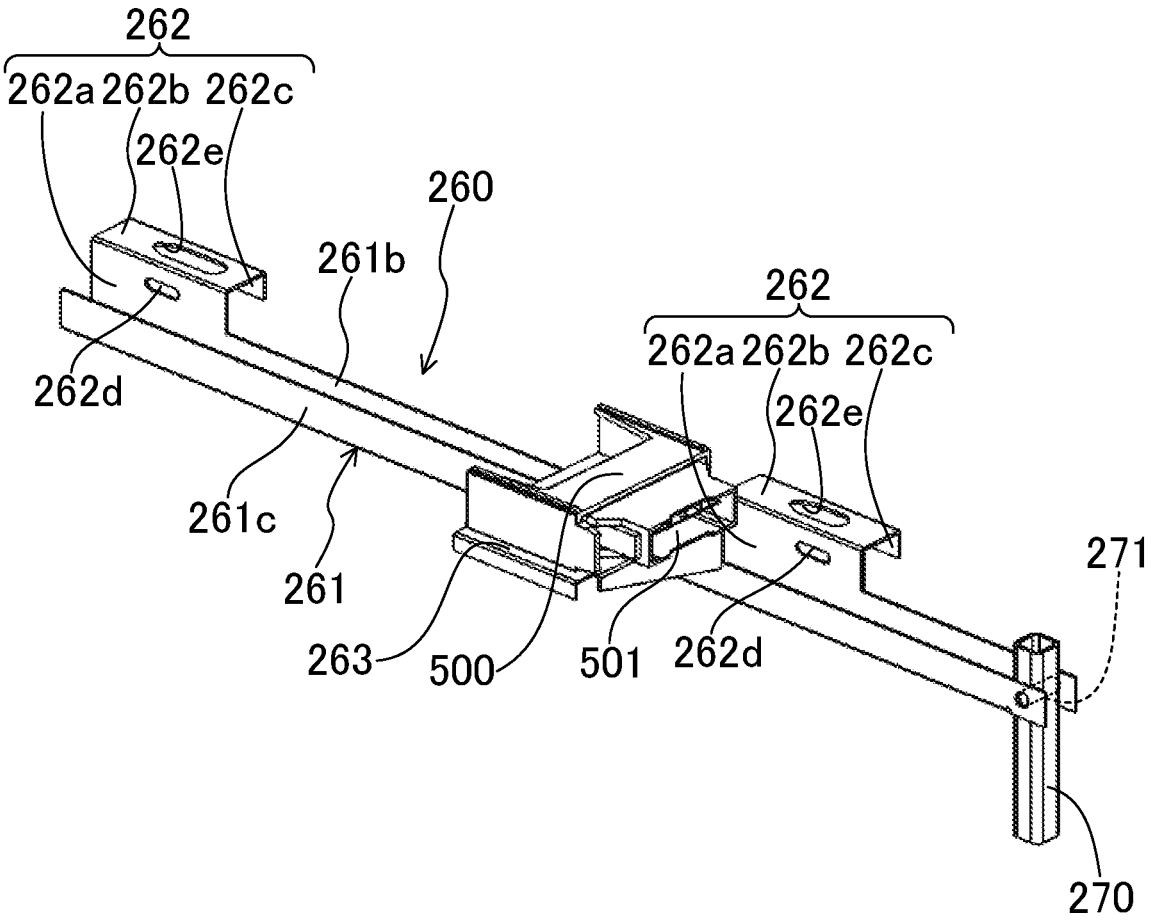
Figure 11:
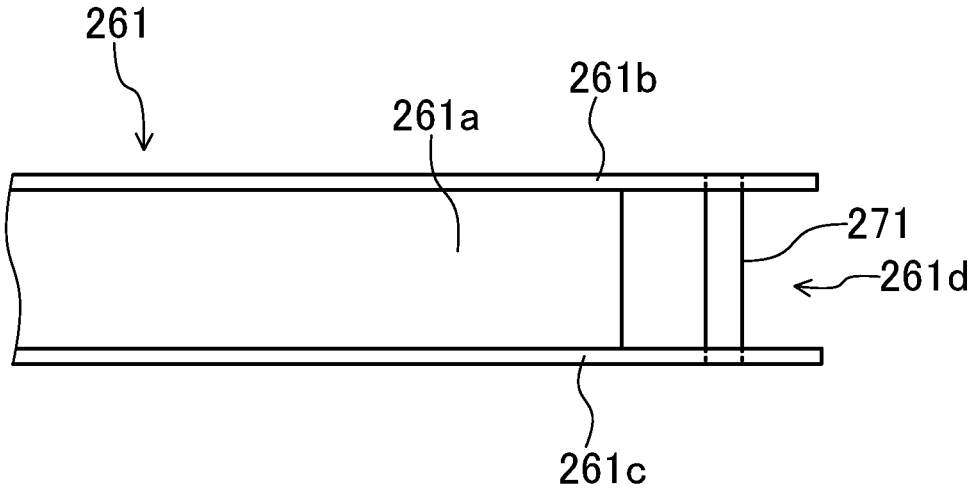
FIG. 11 is a plan view of a left end of the slider as viewed from the upper side.

As shown in FIGS. 9 and 10, the slider 260 has a slider body 261, a pair of left and right pipe engaging parts 262 that engage with the rear horizontal pipe 214 of the optional sheet feeder 20, and a placement board part 263 on which the electrical connector 500 of the optional sheet feeder 20 is placed.

Figure 12A:
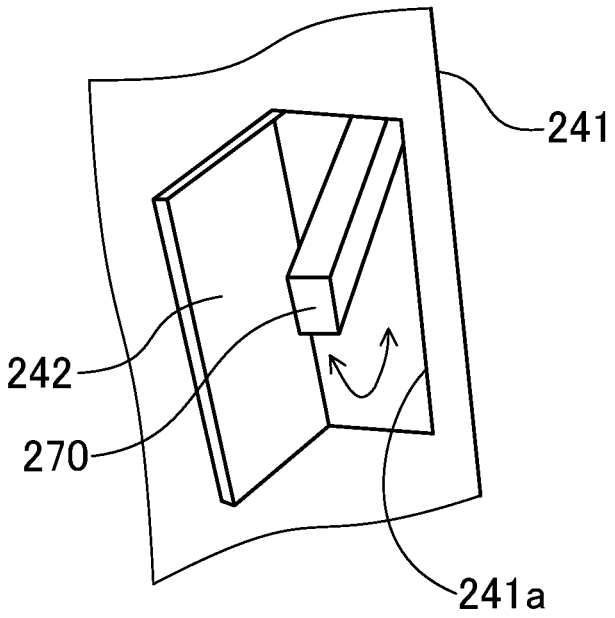
FIG. 12A is a schematic perspective view showing a state where a handle lever is pulled out through a door provided on a control box.
Figure 12B:
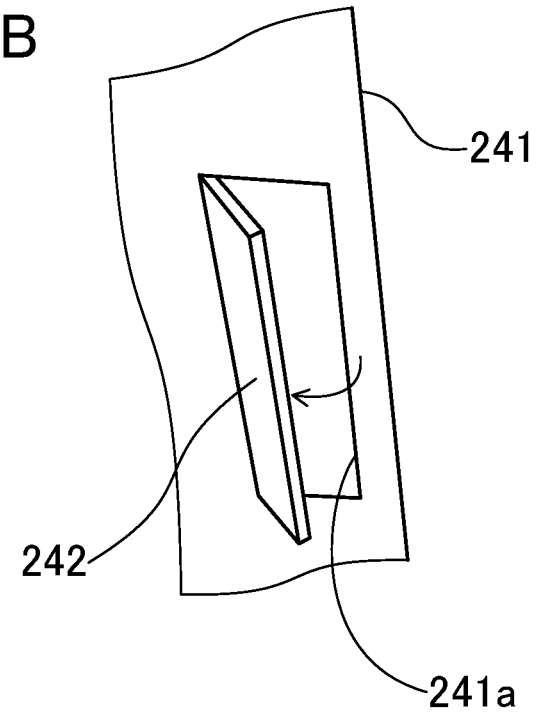
FIG. 12B corresponds to FIG. 12A, but shows a state where the handle lever is folded and housed in the control box.

The slider body 261 is composed of a bar member having a square U-shaped cross section with an open upper side. The slider body 261 has a bottom wall 261*a* (illustrated only in FIG. 11) that has a rectangular plate shape extending horizontally in the left-right direction, and a front side wall 261*b* and a rear side wall 261*c* that are respectively erected from front and rear edges of the bottom wall 261*a*. The placement board part 263 protrudes to the rear side from an intermediate portion in the left-right direction of an upper edge of the rear side wall 261*c*. As shown in FIG. 11, the bottom wall 261*a* of the slider body 261 has a rectangular cutout 261*d* formed at a left end thereof (illustrated on the right side of FIG. 11) for mounting the handle lever 270 therein. The handle lever 270 is composed of a pipe member having a rectangular cross section and is turnably supported on a support pin 271 that extends between the front side wall 261*b* and rear side wall 261*c* of the slider body 261. The handle lever 270 is switchable between a folded state in which the handle lever 270 hangs down vertically from the support pin 271 (see FIGS. 9 and 10) and a deployed state in which the handle lever 270 extends horizontally from the support pin 271. As shown in FIG. 12A, by opening a door 242 that is provided on an outer cover of the control box 241, the handle lever 270 is allowed to be deployed (pulled out) through an opening 241*a*. The handle lever 270 is configured to protrude out of the control box 241 through the opening 241*a* when in the deployed state and to be housed in the control box 241 when in the folded state as shown in FIG. 12B.

Returning to FIGS. 9 and 10, the pair of pipe engaging parts 262 are spaced from each other in left-right direction and connect to the front side wall 261*b* of the slider body 261. Each pipe engaging part 262 is formed to have a square U-shaped cross section so as to engage the rear horizontal pipe 214 of the optional sheet feeder 20 from the upper side. Specifically, each pipe engaging part 262 has a first vertical wall 262*a* that faces a rear side surface of the rear horizontal pipe 214, a horizontal contacting wall 262*b* that is in contact with the upper surface of the rear horizontal pipe 214, and a second vertical wall 262*c* that faces a front side surface of the rear horizontal pipe 214. The space between the first vertical wall 262*a* and the second vertical wall 262*c* is slightly greater than a width of the rear horizontal pipe 214.

The first vertical wall 262*a* of each pipe engaging part 262 has a mounting slot 262*d* formed therein that is elongated in the left-right direction. A pin screw 264 that has a screw portion only at a distal end portion thereof is inserted through the mounting slot 262*d*. Each pipe engaging part 262 is restrained by the pin screw 264 such that it cannot be detached from the rear horizontal pipe 214.

The horizontal contacting wall 262*b* of each pipe engaging part 262 has a locking slot 262*e* (example of through hole) formed therein that is elongated in the left-right direction (in the moving direction of the slider 260). A locking member 152 of the locking mechanism 150 that is described later is inserted through the locking slot 262*e*.

Figure 13:
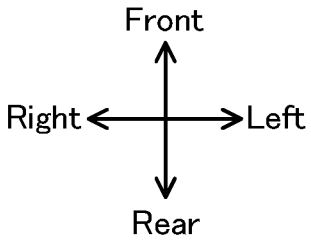
FIG. 13 is an enlarged plan view of a pipe engaging part of the slider.
Figure 13:
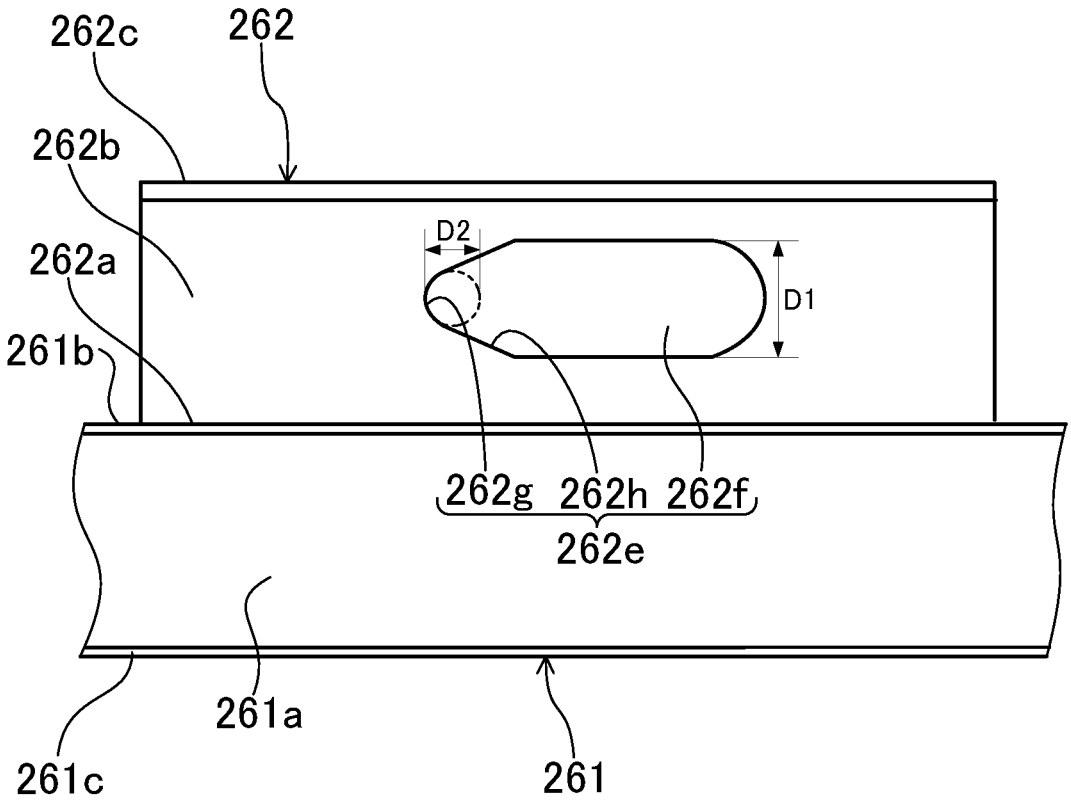

As shown in FIG. 13, the locking slot 262*e* has a large-diameter elongated hole part 262*f*, a small-diameter hole part 262*g* that is located on the right side (the left side of FIG. 13) of the large-diameter elongated hole part 262*f*, and a tapered part 262*h* that connects the large-diameter elongated hole part 262*f* and the small-diameter hole part 262*g*. The large-diameter elongated hole part 262*f* has an elongated hole shape elongated in the left-right direction. The large-diameter elongated hole part 262*f* has a diameter (width) D1 greater than an outer diameter of the locking member 152 that is described later. That is to say, the large-diameter elongated hole part 262*f* is formed to allow the locking member 152 to pass therethrough vertically. The small-diameter hole part 262*g* has a diameter D2 substantially equal to a dimeter of a locking groove 152*d* of the locking member 152 that is described later. The tapered part 262*h* is formed by a pair of inclined surfaces arranged to form a V-shape as viewed from the upper side. The pair of inclined surfaces are formed such that the space therebetween narrows from the left side toward the right side.

[Details of Locking Mechanism 150]

Next, the locking mechanism 150 is described in detail with reference to FIGS. 8 and 14 to 17. As shown in FIG. 8, the locking mechanism 150 includes a pair of mounting brackets 151 that are arranged to be spaced from each other in the left-right direction, and locking members 152 that are respectively fixed to the mounting brackets 151.

Figure 14:
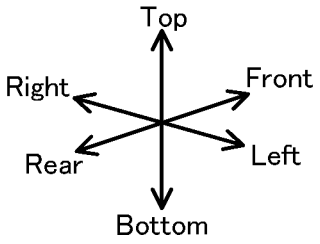
FIG. 14 is a perspective view showing a state where an edge of a locking slot formed in a right pipe engaging part of the slider engages with a right locking member.
Figure 14:
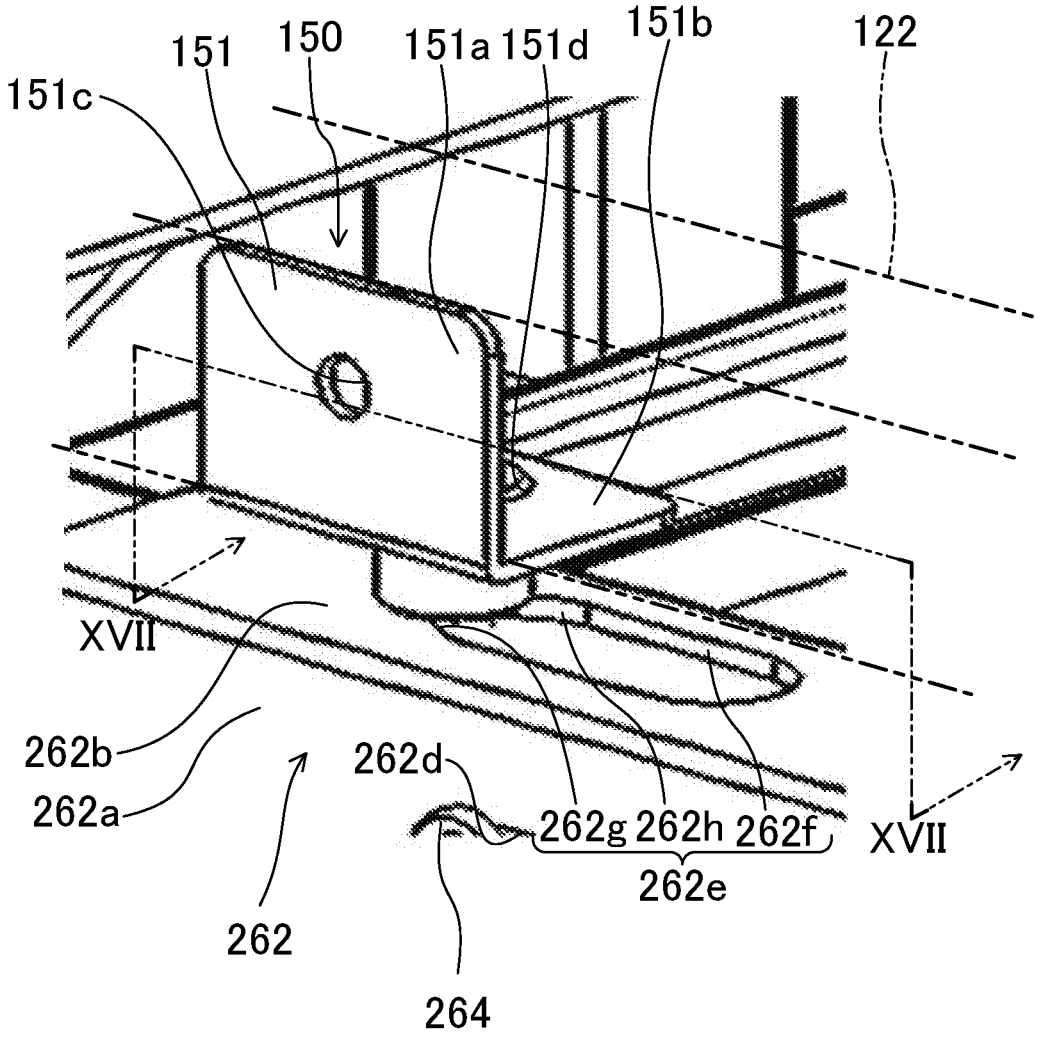
Figure 15:
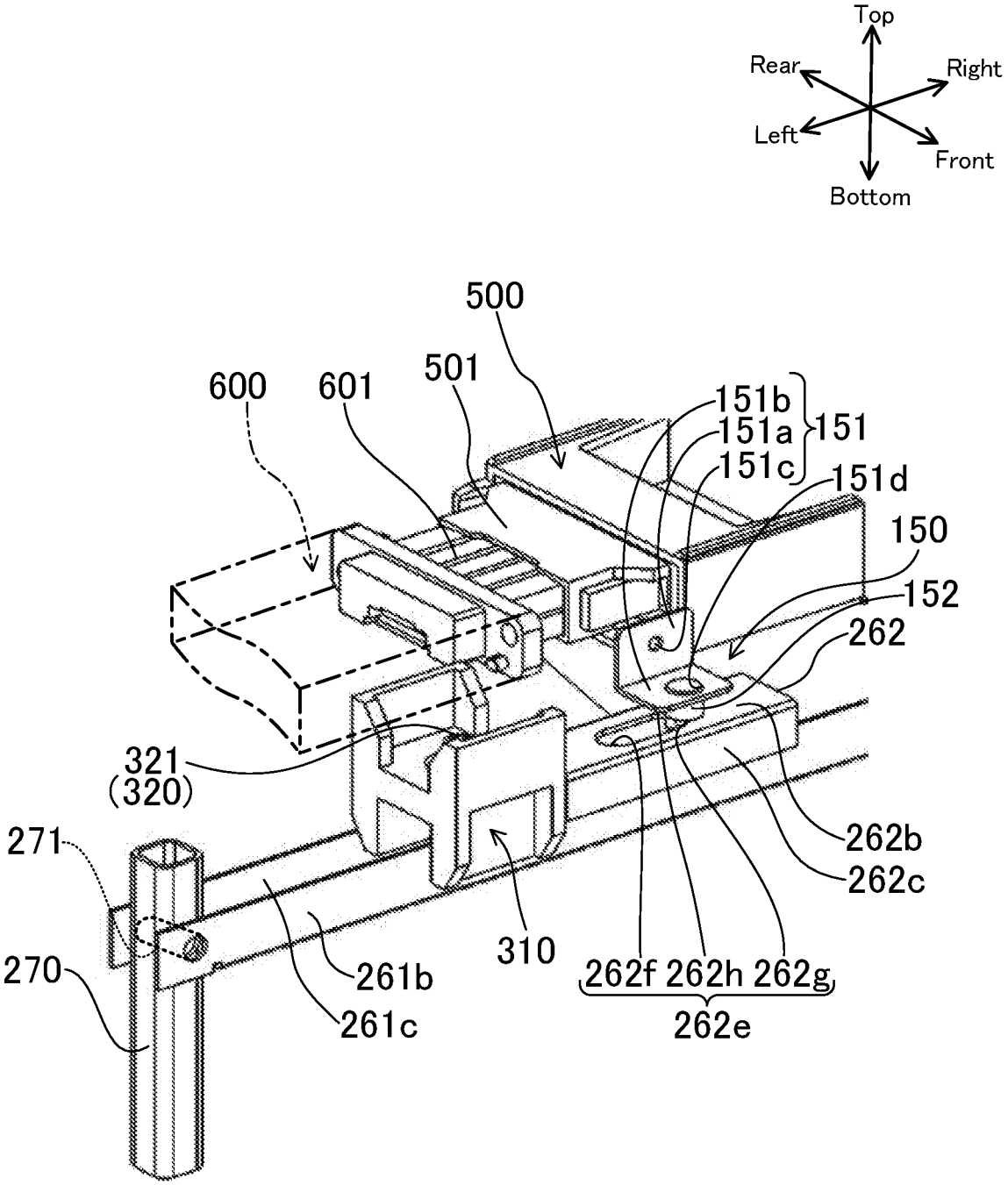
FIG. 15 is a perspective view showing a state where an edge of a locking slot formed in a left pipe engaging part of the slider engages with a left locking member.

The right locking member 152 is inserted through the locking slot 262*e* formed in the right pipe engaging part 262 as shown in FIG. 14. The left locking member 152 is inserted through the locking slot 262*e* formed in the left pipe engaging part 262 as shown in FIG. 15. FIGS. 14 and 15 both show the state where the slider 260 is at the connecting position (the position at which the electrical connectors 500 and 600 are connected to each other). At the connecting position, the locking members 152 are locked such that they cannot be separated vertically from the slider 260, which is described later.

The left and right mounting brackets 151 are fixed to the rear horizontal pipe 122 that constitutes a part of the lower end frame part 120 of the image forming apparatus 1.

Figure 16:
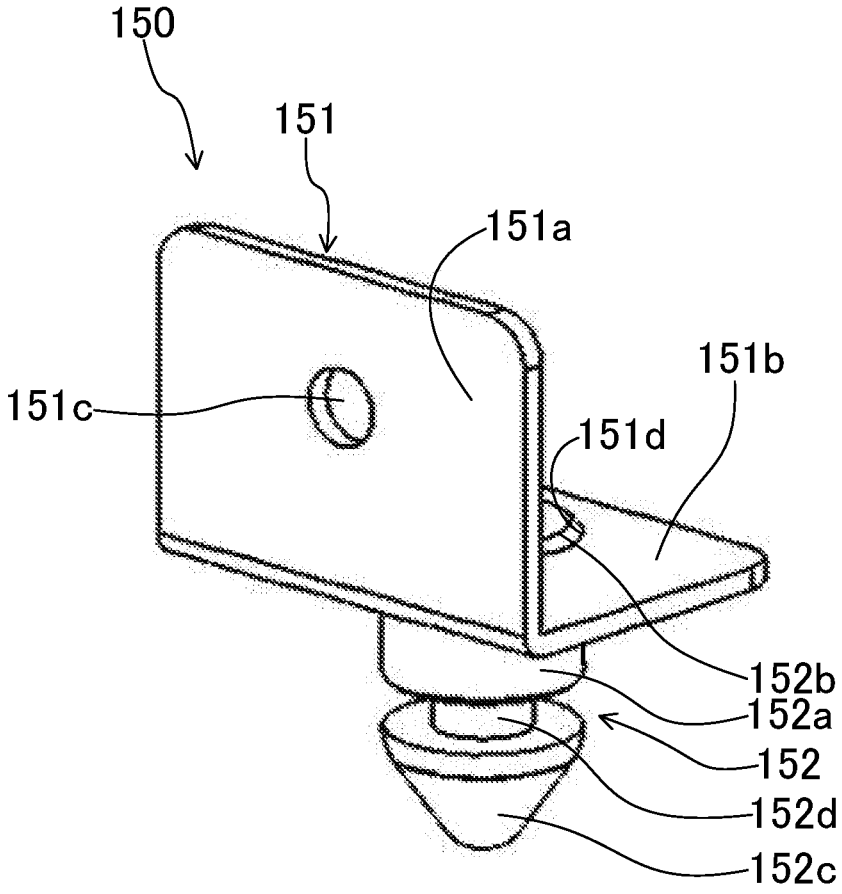
FIG. 16 is a perspective assembled view of a locking member and a mounting bracket to which the locking member is fixed.

As shown in FIG. 16, each mounting bracket 151 is composed of a sheet metal member having an L-shaped cross section. Specifically, each mounting bracket 151 has a vertical plate part 151*a* that is in contact with a rear side surface of the rear horizontal pipe 122 of the image forming apparatus 1, and a horizontal plate part 151*b* that protrudes horizontally to the front side from a lower edge of the vertical plate part 151*a*. The vertical plate part 151*a* has a mounting hole 151*c* formed at a center portion thereof, through which a screw for fixation is inserted. The horizontal plate part 151*b* has a press-fitting hole 151*d* formed at a center portion thereof, in which the locking member 152 is press-fitted and secured.

Figure 17:
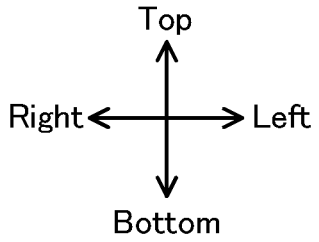
FIG. 17 is a sectional view taken along line XVII-XVII in FIG. 14.
Figure 17:
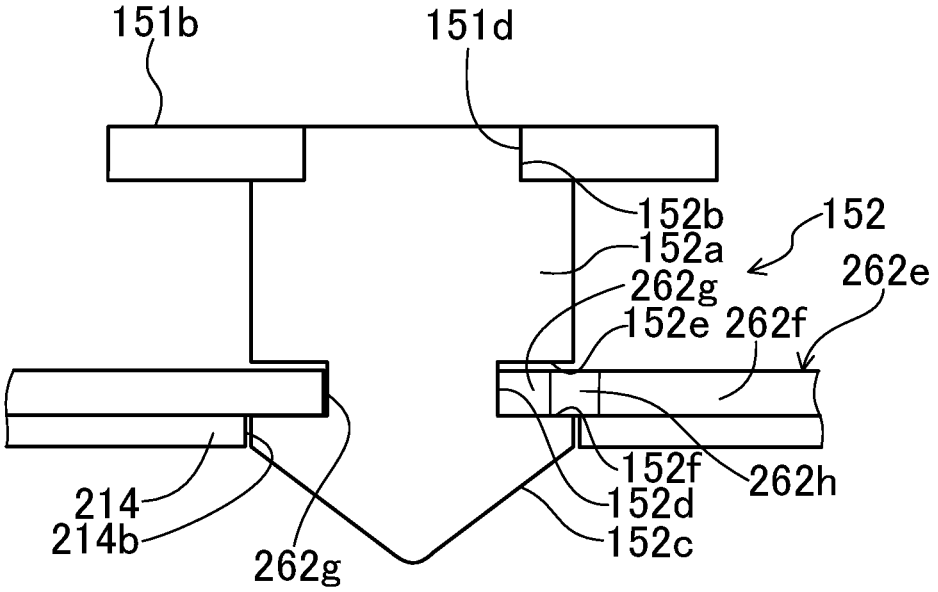

FIG. 17 is a sectional view taken along line XVII-XVII in FIG. 14. Each locking member 152 has a cylindrical part 152*a*, a press-fitting part 152*b* that has a circular board shape and is formed on an upper surface of the cylindrical part 152*a*, a tapered part 152*c* that connects to a lower end of the cylindrical part 152*a* and has a diameter decreasing toward the lower side, and a locking groove 152*d* (example of locking engaged part) that is formed at a lower end portion of the cylindrical part 152*a* to surround an axis of the cylindrical part 152*a*.

The press-fitting part 152*b* is press-fitted in the press-fitting hole 151*d* formed in the horizontal plate part 151*b* of the mounting bracket 151. A step surface that surrounds the press-fitting part 152*b* on the upper surface of the cylindrical part 152*a* is in contact with a lower surface of the horizontal plate part 151*b*. The lower end of the cylindrical part 152*a* is inserted in a through hole 214*b* formed in the rear horizontal pipe 214. The tapered part 152*c* functions as a guide for inserting the lower end of the cylindrical part 152*a* into the locking slot 262*e*. The locking groove 152*d* has a pair of groove surfaces 152*e* and 152*f* that are opposed to each other in the vertical direction. The lower groove surface 152*f* is formed to be flush with the upper surface of the rear horizontal pipe 214.

When the slider 260 is moved to the connecting position (the position shown in FIGS. 14, 15, and 17) from the disconnecting position, a right side edge (an edge of the small-diameter hole part 262*g*) of each locking slot 262*e* of the slider 260 engages the locking groove 152*d* of each locking member 152 so that the locking members 152 and the slider 260 are locked such that they cannot be separated vertically from each other. On the other hand, when the slider 260 is slid rightward from the connecting position to move the slider 260 to the disconnecting position, the image forming apparatus 1 and the optional sheet feeder 20 are electrically disconnected, and simultaneously each small-diameter hole part 262*g* of the slider 260 and the locking groove 152*d* of each locking member 152 are disengaged so that the slider 260 and the locking members 152 are unlocked.

As described above, in this embodiment, moving the slider 260 from the disconnecting position to the connecting position not only establishes an electrical connection between the image forming apparatus 1 and the optional sheet feeder 20 but also fixes the image forming apparatus 1 and the operational sheet feeder 20 such that they cannot be mechanically separated from each other. Thus, the operation of electrically connecting the image forming apparatus 1 and the optional sheet feeder 20 and the operation of mechanically fixing the image forming apparatus 1 and the optional sheet feeder 20 are carried out simultaneously so that the workload of the operator is reduced.

The slider 260 has the handle lever 270 that is able to be gripped by a hand, and the slider 260 is configured to be movable between the connecting position and the disconnecting position through a manual operation using the handle lever 270.

This configuration facilitates the operation of moving the slider 260, as compared with a configuration in which the slider 260 is directly gripped by a hand and moved.

The handle lever 270 is configured to be switchable between the usable state in which the handle lever 270 protrudes out of the control box 241 and the folded state in which the handle lever 270 is housed in the control box 241.

With this configuration, when it is not necessary to use the handle lever 270, the handle lever 270 can be brought into the folded state and housed in the control box 241. This prevents poor appearance caused by the handle lever 270 being unnecessarily exposed outside the control box 241.

The slider 260 has the locking slots 262*e* that penetrate the slider 260 vertically. When the slider 260 is positioned at the disconnecting position, each locking member 152 is positioned in the large-diameter elongated hole part 262*f* of each locking slot 262*e*; therefore, the locking member 152 is allowed to move vertically through the large-diameter elongated hole part 262*f*. When the slider 260 is moved to the connecting position from the disconnecting position, the edge of each locking slot 262*e* engages the locking groove 152*d* of each locking member 152 to function as the locking engaging part.

With this configuration, by positioning the slider 260 at the disconnecting position in advance of installing the image forming apparatus 1 onto the top of the optional sheet feeder 20, the locking members 152 fixed to the image forming apparatus 1 are respectively inserted into the through holes 214*b* of the optional sheet feeder 20 (see FIG. 17) through the large-diameter elongated hole parts 262*f*. Therefore, no interference occurs between the slider 260 and the locking members 152 when the image forming apparatus 1 is installed onto the top of the optional sheet feeder 20. After the distal ends of the locking members 152 are respectively inserted through the through holes 214*b*, by just moving the slider 260 to the connecting position, the edge of each locking slot 262*e* engages the locking groove 152*d* of each locking member 152 so that the locking members 152 and the slider 260 are locked such that they cannot be separated from each other.

The locking slot 262*e* has the large-diameter elongated hole part 262*f* and the small-diameter hole part 262*g* that connects to one end in the longitudinal direction of the large-diameter elongated hole part 262*f*, and the locking slot 262*e* is configured such that the edge of the small-diameter hole part 262*g* engages the locking groove 152*d* of the locking member 152 to function as the locking engaging part.

With this configuration, since the portion of the locking slot 262*e* engaging the locking groove 152*d* is formed as the small-diameter hole part 262*g* that has a smaller diameter than the large-diameter elongated hole part 262*f*, a sufficient engagement allowance is secured as compared with a case where the entire locking slot 262*e* is constituted by the large-diameter elongated hole part 262*f*. Therefore, the locking members 152 and the slider 260 are reliably locked.

What is claimed is:

1. A connecting structure between an electrical connector of a sheet feeder and an electrical connector of an image forming apparatus to be installed onto a top of the sheet feeder, the electrical connector of the image forming apparatus being arranged to expose outward from a bottom surface of the image forming apparatus, the electrical connector of the sheet feeder being arranged to protrude from a top surface of the sheet feeder, the sheet feeder having a slider configured to be horizontally movable, while holding the electrical connector of the sheet feeder, between a connecting position at which the electrical connector of the sheet feeder is connected to the electrical connector of the image forming apparatus and a disconnecting position which is spaced from the connecting position and at which the electrical connector of the sheet feeder and the electrical connector of the image forming apparatus are disconnected, the image forming apparatus having fixed thereto a locking member having a locking engaged part, the slider having provided thereon a locking engaging part configured to be engageable with the locking engaged part, wherein:

when the slider is at the connecting position, the locking engaging part of the slider engages with the locking engaged part of the locking member to lock the locking member and the slider such that the locking member and the slider cannot be separated vertically from each other; and when the slider is at the disconnecting position, the locking engaging part of the slider and the locking engaged part of the locking member are disengaged to unlock the slider and the locking member.

2. The connecting structure of claim 1, wherein the slider has a handle configured to able to be hand-gripped and the slider is configured to be movable between the connecting position and the disconnecting position through a manual operation using the handle.

3. The connecting structure of claim 2, wherein:

the sheet feeder has a box member covering the slider; and the handle is configured to be switchable between a usable state in which the handle protrudes out of the box member and a folded state in which the handle is housed in the box member.

4. The connecting structure of claim 1, wherein:

the locking member has a cylindrical part and has a groove as the locking engaged portion, the groove being formed in a peripheral surface of the cylindrical part to surround an axis of the cylindrical part;

the slider has a through hole having an elongated hole shape, the through hole penetrating the slider vertically and being elongated in a moving direction of the slider; and the though hole is configured such that when the slider is at the disconnecting position, the locking member is allowed to pass through the through hole vertically, and when the slider is moved to the connecting position from the disconnecting position, an edge of the through hole engages the groove to function as the locking engaging part.

5. The connecting structure of claim 4, wherein:

the through hole has a large-diameter elongated hole part and a small-diameter hole part, the large-diameter elongated hole part being elongated in the moving direction of the slider and allowing vertical movement of the locking member, the small-diameter hole part connecting to one end in a longitudinal direction of the large-diameter elongated hole part and having a diameter smaller than a diameter of the large-diameter elongated hole part; and an edge of the small-diameter hole part functions as the locking engaging part.

* * * * *